US006013404A

United States Patent [19]

Feng et al.

[11] Patent Number: 6,013,404

[45] Date of Patent: Jan. 11, 2000

[54] TONER COMPOSITION AND PROCESSES THEREOF

[75] Inventors: James Q. Feng; Dan A. Hays, both of Fairport; Bing R. Hsieh, Webster, all of N.Y.

[73] Assignee: Xerox Corporation, Stamford, Conn.

[21] Appl. No.: 09/169,817

[22] Filed: Oct. 9, 1998

[51] Int. Cl.[7] ..... G03G 9/093

[52] U.S. Cl. ..... 430/106.6; 430/109; 430/126

[58] Field of Search ..... 430/106, 106.6, 430/109, 126

[56] References Cited

U.S. PATENT DOCUMENTS

| | | | |
|---|---|---|---|
| 4,443,527 | 4/1984 | Heikens et al. | 430/39 |
| 4,476,211 | 10/1984 | Hosoi | 430/137 |
| 4,626,490 | 12/1986 | Yamazaki et al. | 430/138 |
| 4,740,443 | 4/1988 | Nakahara et al. | 430/106.6 |
| 4,803,144 | 2/1989 | Hosoi | 430/106.6 |
| 4,937,167 | 6/1990 | Moffat et al. | 430/137 |
| 5,021,315 | 6/1991 | Goldman | 430/106.6 |
| 5,104,763 | 4/1992 | Ong et al. | 430/109 |
| 5,153,092 | 10/1992 | Kao et al. | 430/137 |
| 5,294,513 | 3/1994 | Mitchell et al. | 430/109 |
| 5,780,190 | 7/1998 | Listigovers et al. | 430/138 |

OTHER PUBLICATIONS

"Adhesion of Charged Particles", by Dan A. Hays, *J. Adhesion Sci. Technol.*, vol. 9, No. 8, pp. 1063–1073 (1995).

*Primary Examiner*—John Goodrow
*Attorney, Agent, or Firm*—John L. Haack

[57] ABSTRACT

A toner composition including electrically conductive core resin particles with an electrically insulating shell thereover.

19 Claims, No Drawings

TONER COMPOSITION AND PROCESSES THEREOF

CROSS REFERENCE TO COPENDING APPLICATIONS AND RELATED PATENTS

Attention is directed to commonly owned and assigned U.S. Pat. No. 4,338,222, issued Jul. 6, 1982, entitled "Semiconductive Organic Compositions," which discloses an electrically conducting composition comprising an organic hole transport compound and the reaction product of an organic hole transporting compound and an oxidizing agent capable of accepting one electron from the hole transporting compound.

Attention is directed to commonly assigned copending applications: U.S. Pat. No. 08/950,303 now U.S. Pat. No. 5,853,906, filed Oct. 14, 1997, entitled "Conductive Polymer Compositions and Processes Thereof," which discloses a conductive coating comprising an oxidized oligomer salt, a charge transport component, and a polymer binder, for example, a conductive coating comprising an oxidized tetratolyldiamine salt a monovalent anion, a charge transport component, and a polymer binder; and U.S. Ser. No. 08/883,292 now U.S. Pat. No. 5,826,147, filed Jun. 27, 1997, entitled "Image-Wise Toner Layer Charging for Image Development."

The disclosures of each the above mentioned patent and copending applications are incorporated herein by reference in their entirety. The appropriate components and processes of these patents may be selected for the toners and processes of the present invention in embodiments thereof.

BACKGROUND OF THE INVENTION

The present invention is generally directed to toner compositions and to imaging processes thereof. More specifically, the present invention relates to improved toner compositions and imaging processes thereof, comprising, for example, electrically conductive core particles overcoated or encapsulated with an electrically insulating material. The coated particles have well defined conductivity properties and developability properties as, for example, in single and two component xerographic developers. The toners and developers of the present invention provide a simple and effective solution to the problem of high adhesion attributable to non-uniform surface charge distributions encountered, for example, in conventional single and two component electrophotographic development materials. Furthermore, the conductive core effectively maximizes the polarizability of the toner particles so that the electrorheological cohesion of the toner particles in the direction of the applied electric field is significantly enhanced. The cohesion is highly desirable for multilayer toner transfer in process color printing systems.

The maximized polarization effect due to the conductive core can also significantly reduce the lateral attraction between toner particles of opposite charge polarities as desired in some development processes where toner in the image area and that in the background area are to be separated according to their charge polarities, for example, as in contact electrostatic printing methodologies, reference the aforementioned copending application U.S. Pat. No. 08/883,292 now U.S. Pat. No. 5,826,147.

PRIOR ART

In U.S. Pat. No. 5,021,315, issued Jun. 4, 1991, to Goldman, there is disclosed a method for making magnetic particles having improved conductivity and their use in electrostatographic printing applications, for example, the invention describes the preparation of red colored magnetic particles for multi-component toner compositions which are highly conductive and therefore are suitable for use as developers in high speed electrophotographic copy machines embodying magnetic brush development. Suitable magnetic core particles are provided which are subsequently coated with finely divided particles of copper oxide (CuO). The copper oxide coating is then reduced in-situ on the surface of the core particle to provide an electrically conductive core particle uniformly coated with adherent metallic copper, which particle is red. The invention also provides a method for controlling and adjusting the electrical conductivity and color of toner materials as a function of the amount of metallic copper deposited on the surface of the magnetic core materials.

In U.S. Pat. No. 4,443,527, issued Apr. 17, 1984, to Heikens et al., there is disclosed a colored magnetically attractable toner powder for the development of latent electrostatic or magnetic images comprising a magnetically attractable core, preferably spherical, formed of particulate magnetically attractable material or of a dispersion of such material in a binder, a masking layer enveloping the core and containing binder mixed with light-reflecting pigment of submicron particle size, and coloring material applied in and/or onto the masking layer. Processes for preparing the toner powder are disclosed, and a process for developing electrostatic or magnetic latent image patterns by its use.

In U.S. Pat. No. 4,740,443, issued Apr. 26, 1988, to Nakahara et al., there is disclosed an encapsulated toner for development of electrical latent images comprising a core particle containing a colorant and a soft solid material, inorganic fine particles attached to the vicinity of the surface of the core particle, and a shell coating the core particle and the inorganic fine particles. The inorganic fine particles function to, for example, reinforce the encapsulated toner with a thin shell and may be attached to the core particles through dry-mixing. The core particles with the attached inorganic particles may be coated with a shell resin through phase separation.

In U.S. Pat. No. 4,937,167, issued Jun. 26, 1990, to Moffat et al., there is disclosed a process for controlling the electrical characteristics of colored toner particles comprising: preparing a first core material comprising first pigment particles, core monomers, a free radical initiator, and optional polymer components; preparing a second core material which comprises second pigment particles, core monomers, a free radical initiator, and optional polymer components, the second pigment particles being of a different color from that of the first pigment particles; encapsulating separately the first core material and the second core material within polymeric shells by means of interfacial polymerization reactions between at least two shell monomers, of which at least one is soluble in aqueous media and at least one of which is soluble in organic media, wherein the polymeric shell encapsulating the first core material is of substantially the same composition as the polymeric shell encapsulating the second core material; and subsequently polymerizing the first and second core monomers via free radical polymerization, thereby producing two encapsulated heat fusible toner compositions of different colors with similar triboelectric charging characteristics.

In U.S. Pat. No. 5,153,092, issued Oct. 6, 1992, to Kao et al., there is disclosed a development housing, such as the Xerox Corporation 5900™ development apparatus housing. Blending operations in which carbon black and zinc stearate are introduced simultaneously or sequentially can result in encapsulated toners with less desirable stable electrical characteristics. A highly conductive pigment, such as a conductive carbon black, is added to the toner to form a surface coating which changes the toner from electrically insulative to somewhat conductive. The conductive carbon black will generally have a particle size ranging from about 10 nanometers to about 100 nanometers and can be added to toner in various effective amounts.

In U.S. Pat. No. 4,803,144, issued Feb. 7, 1989, to Hosoi, there is disclosed an electrostatographic toner material suitably employable for the pressure fixing process, which comprises encapsulated toner particles having an average particle size in the range from about 0.5 to 1,000 microns, in which the toner particle comprises a pressure fixable adhesive core material containing colorant and magnetizable substance and a pressure rupturable shell enclosing the core material, the outer surface of the shell being provided with white electroconductive powder.

In U.S. Pat. No. 4,476,211, issued Oct. 9, 1984, to Hosoi, discloses a process for the preparation of an electrostatographic toner material for pressure fixing which is provided with a colored electroconductive powder on the outer surface, and which comprises encapsulating pressure fixable adhesive core material containing colorant and magnetizable substance with shell material in an aqueous medium to prepare encapsulated toner particles and spray-drying the so prepared encapsulated toner particles together with the colored electroconductive powder.

In U.S. Pat. No. 5,294,513, issued Mar. 15, 1994, to Mitchell, et al., discloses encapsulated electrostatographic toner particles and a process for making toner particles. The toner particles comprise a pressure fixable core encapsulated in a pressure rupturable shell with the outer surface of the shell being hydrophobic. Preferably, the outer surface of the shell is rendered hydrophobic by having a thermosetting resin precipitated thereon. The process for producing electrostatographic toner particles comprises preparing a core material, encapsulating a discrete portion of the core material in a shell by interfacial polycondensation, and then treating the outer surfaces of the shells with a thermosetting resin to render them hydrophobic. This enables the particles to be formed as a freeflowing, flowing, dry powder without requiring costly spray drying.

In U.S. Pat. No. 5,104,763, issued Apr. 14, 1992, to Ong, et al., there is disclosed an encapsulated toner composition comprised of a core comprised of a polymer, pigment, dye or mixtures thereof, which core is encapsulated in a polymeric shell having incorporated therein an organosilane moiety as an integral part of the shell structure.

In U.S. Pat. No. 4,626,490, issued Dec. 2, 1986, to Yamazaki et al., there is disclosed an encapsulated toner comprising a core material comprising a binder mixture of a long chain organic compound and an ester of a higher alcohol and a higher carboxylic acid is encapsulated with a thin shell material to give an encapsulated toner. The encapsulated toner has a uniform structure and a narrow particle size distribution and is excellent in developing and fixation characteristics, when used in electrophotography.

Also of interest are U.S. Pat. Nos. 3,893,932 and 5,120,632 which disclose encapsulated toners.

The disclosures of each the aforementioned patents are incorporated herein by reference in their entirety. The appropriate components and processes of these patents may be selected for the toners and processes of the present invention in embodiments thereof.

There remains a need for toner compositions which possess well defined and regulated conductivity properties, and which properties are highly resistant to changes in ambient conditions, such as humidity, or upon aging.

The toner and developers of the present invention are useful in many applications, for example, as a variety of applications including toners for use in electrophotographic imaging processes, such as digital printing and copying system including color systems, and for use for example, in liquid marking, such as liquid xerography and ink jet printing applications.

SUMMARY OF THE INVENTION

Embodiments of the present invention, include:

A toner composition comprising electrically conductive core particles with an electrically insulating shell thereover;

A toner composition comprised of a core comprised of a polymer, and a colorant such as a pigment, a dye, or mixtures thereof, wherein the core is electrically conductive and is encapsulated within an electrically insulating polymeric shell, and wherein the colorant is present in an amount of from about 1 to about 65 weight percent of the toner;

An imaging process comprising developing latent images with a toner comprising electrically conductive core particles with an electrically insulating polymer shell thereover, wherein the electrically conductive core redistributes charge in the toner particle and eliminates non-uniform particle surface charge effects and print defects resulting therefrom;

An imaging process employing the aforementioned toner particles which particles maximize the polarizability of toner particles to reduce or eliminate a lateral attraction force between particles of opposite charge polarities while enhancing attraction between toner particles in the applied electric field direction thereby improving developability and print quality by separating the toner particles in the image area and in the background area according to charge polarities; and An imaging process wherein transfer of multilayers of the aforementioned toner particles improves the electrostatic transfer efficiency by enhancing electrorheological cohesion in the direction of the applied electric field.

These and other embodiments of the present invention are illustrated herein.

DETAILED DESCRIPTION OF THE INVENTION

The toners and developers of the present invention provide a simple and effective solution to the problem of particle electrostatic adhesion due to the non-uniform surface charge distribution as encountered, for example, in conventional single and two component electrophotographic development systems and processes.

In electrophotographic processes, toner particles are typically charged by triboelectric processes so that the particles can be manipulated by electrostatic forces. Many insulative toner particles, for example, comprising a resin and a pigment, and optionally a surface charge additive or internal charge additive, are well known in the art of electrophotographic printing. A significant problem associated with prior art insulative toners is that accurate control of toner charge with an electrostatic force becomes difficult and is complicated by the conspicuously patchy distribution of charges on the particle's surface, that is, uneven or non-uniform distribution of charge density on the surface of the toner particles. The patchy distribution of charge on the particle's surface generally enhances electrostatic adhesion of the particle on the residing surface such that the particle may not be detached from the residing surface by an applied electric field of strength within the air breakdown limit, reference and compare, for example, the article on "Adhesion of Charged Particles" by D. A. Hays, in *J. Adhesion Sci. Technol.*, Vol. 9, No. 8, pp. 1063–1073(1995). This phenomena causes problems, for example, in cleaning efficiency and print quality. The present invention in embodiments provides toner and developer compositions, and imaging processes thereof in electrostatographic, for example, xerographic printing processes, wherein the problems associated with the non-uniform charge distribution problem are effectively minimized.

In liquid electrophotography, the electric-field-induced cohesion of toner particles is believed to suppress smear image defects due to shear stresses in the liquid flow, see for example, Crowley et al. in *J. Electrostatics*, Vols. 40 & 41, pages. 585–590 (1997). The electric-field induced cohesion is an electrorheological phenomenon due to the interactions among electric-field induced dipoles in toner particles. The toner particles in conventional liquid electrophotography, however, have little polarizability because of their small contrast in dielectric constant with respect to that of the carrier liquid.

The present invention provides toner particles comprised of electrically conductive core particles which cores are coated or encapsulated within an electrically insulating shell such as a thin and substantially continuous polymeric coating. Although not wanting to be limited by theory it is believed that the conductive core nullifies the effect of a non-uniform surface charge distribution for the purpose of removing shortfalls in developer performance. The insulating shell prevents electric field induced charge exchange between adjacent or nearby toner particles, and also prevents charge exchange between particles and contacting surfaces, such as the developer delivery system, developer housing, or toner and developer reclaim or reuse systems, so that individual particles retain substantially all of the original charge obtained in a charging process for desired electric field manipulation. The toner particles of the present invention with conductive cores are believed to maximize the polarizability of toner particles, and accordingly, in an applied electric field, interparticle cohesion is enhanced along the field direction. The enhanced cohesion can improve, for example, transfer efficiencies in multilayer toner transfer processes, for example, as found in many xerographic and liquid xerographic color printing processes. Moreover, the electrorheological cohesion is actually non-isotropic or direction-dependent because dipoles attract when aligned, in terms of dipole moment vectors, in a head-to-tail configuration whereas the particles repel when aligned in a side-by-side configuration. Thus, the maximized polarization effect due to the conductive core can also significantly reduce the lateral attraction between toner particles of opposite charge polarities as desired in some development processes where toner in the image area and that in the background area are to be separated according to their charge polarities.

The electrically conductive core particles can be a mixture of at least one resin and conductive additives, for example, including one or more electrically conductive polymers, metal particles, metal oxide particles, conductive fluorocarbon particles, polyanilines, polypyrroles, polythiophenes and conductive charge transfer complexes, and mixtures thereof. Conductive charge transfer complexes are disclosed, for example, in "Introduction to Molecular Electronics," M. C. Petty et al., Ed., 1995. The core particles can in embodiments comprise at least one resin, and in other embodiments, for example, from 2 to about 10 resins. The conductive additive particles can be, for example, carbon black, graphite, conductive pigments, conductive metal halides such as copper iodide, ionic salts, and the like conductive materials, and mixtures thereof. The affixed electrically insulating shell can be at least one insulating resin, a mixture of resins, and mixtures thereof with insulating metal oxide particles. In embodiments, there can be selected from 2 to about 10 insulating resins. The insulating resins can be, for example, polymers or copolymers such as acrylates, such as poly(methyl methacrylate), styrenes, such as polystyrene, polyesters and polycarbonates, such as bisphenol A polycarbonate, a condensation polymer of terephthalic acid, ethylene glycol and 2,2'-bis-[4-(2-hydroxyethoxy)]propane, a polymer or copolymer of polysilane, polyamide, polyimide, mixtures thereof and copolymers thereof, reference for example, U.S. Pat. Nos. 5,516,983, and 4,327,169, the disclosures of which are incorporated herein by reference in their entirety.

The core particles can be comprised of a polymer or copolymer resin such as acrylates, styrenes, polyesters, and the like binder resins, and mixtures thereof. Where the conductivity of the core polymer alone is insufficient to impart significant electrically conductivity, for example, any value greater than about $10^{-10}$ (ohm-cm)$^{-1}$, there can be included in the core resin a conductive additive to render the core adequately electrically conductive. The core polymer can be prepared by known polymerization methodologies, such as by free-radical polymerization, stable free radical mediated polymerization processes, anionic, cationic, condensation polymerization, and the like polymerization processes. Examples of suitable unsaturated monomers for polymerization to core or shell polymer resins include: n-butyl acrylate, s-butyl acrylate, isobutyl acrylate, butyl methacrylate, s-butyl methacrylate, isobutyl methacrylate, benzyl acrylate, benzyl methacrylate, propyl acrylate, isopropyl acrylate, hexyl acrylate, cyclohexyl acrylate, hexyl methacrylate, cyclohexyl methacrylate, lauryl acrylate, lauryl methacrylate, pentyl acrylate, pentyl methacrylate, stearyl acrylate, stearyl methacrylate, ethoxypropyl acrylate, ethoxypropyl methacrylate, heptyl acrylate, heptyl methacrylate, methylbutyl acrylate, methylbutyl methacrylate, m-tolyl acrylate, styrene, methyl styrene, ethyl styrene, propyl styrene, butyl styrene, dodecyl styrene, hexylmethyl styrene, nonyl styrene, tetradecyl styrene, and mixtures thereof.

When electrically conductive polymers are selected as the core polymer or for inclusion as a component of the toner core particles, for example, in admixture with conventional low conductivity or insulating polymeric resin materials, the electrically conductive polymers can be present in amounts of from about 1 to about 95 weight percent of the core particle. Examples of electrically conducting polymers useful in the present invention include polypyrroles, polyanilines, polyparaphenylenes, polyparaphenylenevinylenes, polythiophenes, polyazines, polyfuranes, polyselenophenes, polyphenylene sulfides, polyacetylenes, and the like materials, and mixtures thereof. Electrically conducting polymers are known in the art and illustrative examples include those polymers disclosed in, for example, U.S. Pat. Nos. 5,714,053, which discloses electrically conductive polymers derived from polypyrrole;

5,645,764, which discloses electrically conductive polymers including substituted and unsubstituted polyanilines, substituted and unsubstituted polyparaphenylenes, substituted and unsubstituted polyparaphenylenevinylenes, substituted and unsubstituted polythiophenes, substituted and unsubstituted polyazines, substituted and unsubstituted polyfuranes, substituted and unsubstituted polypyrroles, substituted and unsubstituted polyselenophenes, substituted and unsubstituted polyphenylene sulfides and substituted and unsubstituted polyacetylenes formed from soluble precursors, blends of the substituted and unsubstituted polymers, and copolymers made from the monomers used to form the polymers; 4,869,949, which discloses electrically conductive polymers of pyrrole, of furan, of thiophene and of aniline; and 4,636,430, which discloses oxidized pyrroles, thiophenes, and anilines. Other examples of suitable conductive polymers are disclosed in, for example, U.S. Pat. No. 4,338,222, and the aforementioned copending application U.S. Ser. No. 08/950,303 now U.S. Pat. No. 5,853,906, the disclosure of these and the aforementioned patents are incorporated by reference herein in their entirety.

The aforementioned electrically conductive polymers can include one or more dopant materials for example, to improve the physical, developmental, and imaging properties of the toner particles.

The electrically conductive core particles can be, for example, an oxidized organic salt, a charge transport compound, a colorant, and mixtures thereof, in an amount of from about 1 to about 65 weight percent of the toner; in combination with a polymer resin. The polymer resin can be an inert polymer, a charge transport polymer, or mixtures thereof, such that the conductivity requirement of the fully formulated core particles is achieved. The inert polymers can be, for example, vinyl polymers and copolymers thereof, norbornene polymers, condensation polymers such as polyesters, polycarbonate, and their copolymers; silicone polymer resins, such as polysiloxanes and polysilanes, and mixtures thereof, in an amount of from about 30 to about 80 weight percent of the total weight of the core. Charge transport polymers include, for example, arylamine containing polymers, aryldiamine containing polymers, polyvinylcarbazoles, polypolythiophenes, polysilanes, polyanilines, poly(phenylene vinylenes), polyphenylenes, poly(phenylene sulfides), polyanilines, poly(phenylene sulfide phenylenamine), copolymers thereof, and mixtures thereof. The oxidized organic salt can be oxidized arylamine salts, oligo-aryldiamine salts, oxidized oligo-thiophene salts, oxidized oligo-aniline salts, oxidized porphyrin salts, oxidized tetrathiotetracene salts, oxidized tetraselenotetracene salts, oxidized mono and oligo-tetrathiafulvalene salts, oligo-tetraselenafulvalene salts, oxidized oligometallocene salts, and mixtures thereof. The charge transport compound can be, for example, N,N,N-triarylamine containing compounds, carbazole compounds, oligothiophene compounds, carbon-60 fullerene compounds, and mixtures thereof.

In embodiments, there can be selected a mixture of oxidized organic salt and charge transport compound as the conductive core in a respective weight percent ratio of from about 0.01:99.99 to about 99.99:0.01. Alternatively, there can be selected a mixture comprised of oxidized organic salt and a mixture of charge transport compound and polymer resin, in a weight percent ratio of oxidized organic salt to the combined weight of charge transport compound and polymer resin of from about 10:90 to about 90:10.

The electrically insulating shell can be at least one insulating resin, a mixture of resins, and mixtures thereof with insulating particles such as metal oxide particles, and for example, where from 2 to about 10 insulating resins are selected. Examples of the insulating resins include polymers or copolymers, such as, acrylates, styrenes, polyesters, polysiloxanes, norbornene polymers, polycarbonates, and the like materials, and mixtures thereof.

The shell or encapsulating layer can be present in amounts of from about 0.1 to about 30 weight percent of the toner, and the core resin or resins can be present in amounts of from about 20 to about 98 weight percent of the toner.

The core particles can have a volume average diameter of from about 0.1 to about 100 microns, preferably from about 0.1 to about 40 microns, and more preferably from about 0.1 to about 10 microns. The shell can have a thickness of from about 0.0005 to about 5 microns, and preferably from about 0.001 to about 2.0 microns. The electrically insulating shell is preferably formed on the core particles with a thickness which is as thin as practically possible, and preferably without creating any gaps, holes, or the like defects, in the shell coating. Such defects may substantially impair the shell's ability to insulate the core particle from charge exchange, charge sharing, or charge leakage, with other coated or uncoated core particles or developer processing hardware. The thickness of the shell coating is selected in view of several competing interests, for example, the cost and difficulty of forming the thinnest possible coating; the incident of shell coating defects as the thickness is made thinner; and the desired conductivity/resistivity properties consistent with a robust shell coating, that is, a shell with a thickness which will not be easily ruptured or worn away under typical conditions experienced in toner and developer processing equipment and in electrostatographic hardware, such as in a high intensity mixer or agitation developer housing. When the toner particles of the present invention are selected for use in a liquid developer and liquid development processes, for example, in liquid xerography employing a non conducting liquid carrier vehicle such as hydrocarbon available commercially as NORPAR® or ISOPAR® the shell can be thicker without impairing the objects of the present invention since interparticle charging and the like charging phenomena are reduced for particles contained in a non conductive medium. For liquid developers, the shell can have a thickness of from about 0.0001 to about 5 microns, and preferably from about 0.001 to about 2.0 microns.

The core and shell resin can be at least one resin with a weight average molecular weight (Mw) of from 1,000 to about 500,000 and preferably from about 2,000 to about 250,000, and a number average molecular weight (Mn) of from about 1,000 to about 500,000, and preferably from about 2,000 to about 250,000. The shell can optionally include known surface additives present in amounts of from about 0.05 to about 5 weight percent. Suitable surface additives include, for example, metal salts, metal salts of fatty acids, colloidal silicas, and the like materials, and mixtures thereof.

Depending upon the selection of resin and additive types used for the core and the shell, their relative amounts, and the like considerations, the resulting toner can have an apparent conductivity comparable to that of the electrically insulating shell; the electrically conductive core can have a conductivity of any value greater than about $\mathbf{10}^{-1}$ (ohm-cm)$^{-1}$; and the electrically insulating shell can have a conductivity of less than about $10^{-15}$ (ohm-cm)$^{-1}$. Thus the toner can have a conductivity of from about $\mathbf{10}^{-15}$ to about $10^{-10}$ (ohm-cm)$^{-1}$, the electrically conductive core has a conductivity of from about $10^{-5}$ to about $10^{-9}$ (ohm-cm)$^{-}$, and the electrically insulating shell has a conductivity of from about $10^{-15}$ to about $10^{-18}$ (ohm-cm)$^{-}$. The electric properties of polymers selected for used in the present invention can be readily determined and characterized, and have been summarized, reference "Macromolecules," 2d Ed., Vol. 1, Chapter 13, H-G Elias, Plenum, N.Y., 1984, the disclosure of which is incorporated by reference herein in its entirety.

The present invention includes a toner composition comprised of electrically conductive core particles coated with a continuous layer of insulating materials, wherein the insulating materials are affixed to the surface of the core particles.

The present invention includes toner compositions comprised of a core comprised of a polymer, and a colorant, such as a pigment, a dye, or mixtures thereof, wherein the core is electrically conductive and is encapsulated within an electrically insulating polymeric shell, and wherein the colorant is present in the an amount of from about 1 to about 65 weight percent of the toner. A variety of colorants can be selected for use in the present invention. Pigments are preferred colorant materials because of there color values, color stability, and conductivity properties, and include, for example, carbon blacks, magnetites, cyan, yellow, magenta, red, green, blue, brown, orange, or mixtures thereof, and the like colors.

The present invention, in embodiment, provides imaging processes comprising: developing latent images with a toner comprising electrically conductive core particles with an electrically insulating polymer shell thereover, wherein the electrically conductive core redistributes charge in the toner particle and eliminates non-uniform particle surface charge effects and print defects resulting therefrom. In embodiments, imaging processes comprise: developing latent images by separating toner in the image area and that in the background area according to their charge polarities with a toner comprising electrically conductive core particles with an electrically insulating polymer shell thereover, wherein the electrically conductive core maximizes the polarizability of the toner particles so as to reduce or eliminate lateral attraction force between toner particles of opposite charge polarities while enhancing attraction between toner particles in the applied electric field direction to improve developability and print quality. In embodiments, the imaging processes further comprise: transferring developed multilayer toner particles with a toner comprising electrically conductive core particles with an electrically insulating polymer shell thereover, wherein the electrically conductive core maximizes the polarizability of the toner particles and improves transfer efficiency through enhanced electrorheological cohesion in the direction of the applied electric field.

The toner compositions of the present invention can be used in numerous marking processes, such as in liquid and dry electrostatographic developer marking applications in a cost efficient manner. An advantage of the present invention is that the imaging processes afford control over the surface and conductivity properties of the coated particulate products, and control over the extent or level and location or distribution of the charge on the surface of the toner particles. Consequently the toner particles can be easily manipulated and controlled by the application of external forces, such as an electric field.

Toner compositions can generally be prepared by a number of known methods, such as admixing and heating resin particles obtained with the processes of the present invention such as water soluble or insoluble styrene butadiene copolymers, pigment particles such as magnetite, carbon black, or mixtures thereof, and cyan, yellow, magenta, green, brown, red, or mixtures thereof, and preferably from about 0.5 percent to about 5 percent of charge enhancing additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 4 to about 10 microns, which diameters are determined by a Coulter Counter. Subsequently, the toner compositions can be classified utilizing, for example, a Donaldson Model B classifier for the purpose of removing toner fines, that is toner particles less than about 4 microns volume median diameter. Alternatively, the toner compositions are ground with a fluid bed grinder equipped with a classifier wheel constructed in accordance with the present invention, and then classified using a classifier equipped with a classifier wheel constructed in accordance with the present invention. In other preparative methods the toner particles and developers of the present invention can be readily obtained from emulsion-aggregation processes.

Illustrative examples of resins suitable for toner and developer compositions of the present invention include branched and linear styrene acrylates, styrene methacrylates, styrene butadienes, vinyl resins, including branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. Preferred toner resins include styrene butadiene copolymers, mixtures thereof, and the like. Other preferred toner resins include styrene/n-butyl acrylate copolymers, PLIOLITES®; and suspension polymerized styrene butadienes, reference U.S. Pat. No. 4,558,108, the disclosure of which is totally incorporated herein by reference.

In toner compositions, the resin particles are present in a sufficient but effective amount, for example from about 70 to about 90 weight percent. Thus, when 1 percent by weight of a charge enhancing additive is present, and 10 percent by weight of pigment or colorant, such as carbon black, is contained therein, about 89 percent by weight of resin is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black like REGAL 330®, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected.

When the pigment particles are comprised of magnetites, thereby enabling single component toners in some instances, which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

There can also be blended with the toner compositions of the present invention external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 10 percent by weight, and preferably in an amount of from about 0.1 percent by weight to about 5 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated with the charge additives in an amount of from about 1 to about 30 weight percent and preferably 10 weight percent followed by the addition thereof to the toner in an amount of from 0.1 to 10 and preferably 0.1 to 1 weight percent.

Also, there can be included in the toner insulating shell or core low molecular weight waxes, such as polypropylenes and polyethylenes commercially available from Allied Chemical and Petrolite Corporation, EPOLENE N-15® commercially available from Eastman Chemical Products, Inc., VISCOL 550-P®, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are optionally present in the toner insulating shell or core in various amounts, however, generally these waxes are present in the toner composition in an amount of from about 1 percent by weight to about 15 percent by weight, and preferably in an amount of from about 2 percent by weight to about 10 percent by weight of the toner and may in embodiments function as fuser roll release agents.

Encompassed within the scope of the present invention are colored toner and developer compositions comprised of toner resin particles, carrier particles, the charge enhancing additives, and as pigments or colorants red, blue, green, brown, magenta, cyan and/or yellow particles, as well as mixtures thereof in the core and shell of the toner. More specifically, with regard to the generation of color images utilizing a developer composition with charge enhancing additives, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition core and or shell in an amount of from about 2 percent by weight to about 15 percent by weight calculated on the weight of the toner resin particles.

For the formulation of developer compositions, there are mixed with the toner particles carrier component particles, particularly those that are capable of assuming an opposite triboelectric charge polarity to that of the toner composition. Accordingly, the carrier particles can be selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. No. 3,526,533, U.S. Pat. No. 4,937,166, and U.S. Pat. No. 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 30 microns to about 250 microns, and in embodiments about 60 microns thereby permitting them to possess sufficient density and inertia to avoid adherence to the electrostatic images during the development process. The carrier component can be mixed with the toner composition in various suitable combinations, however, best results are obtained when about 1 to about 5 parts per toner to about 10 to about 200 parts by weight of carrier are selected.

The toner composition of the present invention can be prepared by a number of known methods including extrusion melt blending the core toner resin, pigment particles or colorants, and a charge enhancing additive, followed by mechanical attrition. Other methods include those well known in the art such as microencapsulation, spray drying, melt dispersion, emulsion aggregation, and extrusion processing. Also, as indicated herein the toner composition without the charge enhancing additive in the insulating shell can be prepared, followed by the addition of charge additive surface treated colloidal silicas. When microencapsulation is selected as a method for toner particle preparation, known microencapsulation processes can be used, for example, U.S. Pat. No. 5,763,130, and U.S. Pat. No. 5,604,027, the disclosures of which are incorporated by reference herein in the their entirety. The toner and developer compositions may be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The toner compositions, if desired, can be classified subsequent to preparation to enable encapsulated toner particles with a preferred average diameter of from about 1 to about 25 microns, more preferably from about 2 to about 12 microns, and most preferably from about 4 to about 8 microns. Although when in situ toner or chemical toner methods are used to prepare the encapsulated toner particles of the present invention, jetting and classification of the toner particles is generally unnecessary. Also, the toner compositions preferably possess a triboelectric charge of from about 0.1 to about 2 femtocoulombs per micron as determined by the known charge spectrograph. Admix time for toners are preferably from about 5 seconds to about 1 minute, and more specifically from about 5 to about 15 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 180 copies per minute.

Also, the toner compositions prepared, in embodiments, of the present invention possess desirable narrow charge distributions, optimal charging triboelectric values, preferably of from 10 to about 40, and more preferably from about 10 to about 35 microcoulombs per gram as determined by the known Faraday Cage methods with from about 0.1 to about 5 weight percent in one embodiment of the charge enhancing additive; and rapid admix charging times as determined in the charge spectrograph of less than 15 seconds, and more preferably in some embodiments from about 1 to about 14 seconds.

The invention will further be illustrated in the following nonlimiting examples, it being understood that these examples are intended to be illustrative only and that the invention is not intended to be limited to the materials, conditions, process parameters, and the like, recited herein. Parts and percentages are by weight unless otherwise indicated.

EXAMPLE I

Modeling Electrostatic Force on Toner Particles with and without Electrically Conductive Core and Electrically Insulating Shell:

To quantitatively evaluate the effect of the insulating skin or shell on the removal of the charge-patch effect and concomitant problems, a finite element model was used to compute the electrostatic force on a charged sphere resting on a conductive surface. Comparisons were made between the results for a dielectric sphere with a conductive core, referred to as an electrically isolated conductive particle, and a dielectric sphere without a conductive core, referred to as insulative particle. Results for uniform and nonuniform charge distributions on the particle surface were examined. The nonuniform charge distribution can be represented by a function of polar angle $\theta$ proportional to $[1-\cos(\theta)]$, corresponding to the axisymmetric charge distribution with charge pooled near the conductive substrate. For a given amount of charge on the particle, the threshold strength of the applied field for detaching a nonuniformly charged insulative particle is about 25 percent greater than that for the same particle with a uniform charge distribution. In the presence of a conductive core with a radius of about 90 percent of the total particle radius, that is including the thickness attributable to the insulating skin or shell, which is for example about 10 percent of the particle radius, the computed threshold field strength for detaching the electrically isolated conductive particle with nonuniform charge distribution is about 6 percent greater than that for the same particle with a uniform charge distribution, which indicates a significant reduction of the charge-patch effects. The thinner the insulating skin is, the more charge-patch effects can be removed. For example, if the radius of conductive core is made about 95 percent of the particle radius, the threshold field strength for detaching a nonuniformly charged electrically isolated conductive particle becomes only about 3 percent greater than the same particle with a uniform charge distribution. To evaluate the magnitude of electrostatic force on a nonuniformly charged electrically isolated conductive particle, a comparison was accomplished with, for example, a uniformly charged insulative particle which is the most desirable situation for an insulative particle in electrophotographic applications because of the absence of the charge patches. The finite element computations suggest that the range of the strength of the externally applied electric field that allows electrostatic force to detach the particle for a given amount of particle charge is narrower for electrically isolated conductive particles than for uniformly charged insulative particles, with peak values of the electrostatic force for both cases appearing at about the same field strength. But the peak value of electrostatic detaching force for the electrically isolated conductive particles is about 20 percent greater than that for uniformly charged insulative particles. Hence, for particles with the same amount of charge, those with a conductive core are expected to detach at the same field strength as for detaching a uniformly charged insulative particle.

An exemplary electrostatographic toner of the present invention can comprise, for example, a pressure fixable polymer core material containing a colorant and magnetizable substance, and a shell polymer material, for example, with about 1 part by weight of shell material to about 1 part by weight core material, to from about 1 part by weight of shell material to about 99 parts by weight of core material. A preferred range is a core shell ratio of from about 0.1 weight percent of shell material to about 30 weight percent of core material, and from about 100 weight percent of shell material to about 70 weight percent of core material as encapsulated toner particles. In general, the thickness of the shell material may be controlled by the ratio of the amount of core material to be encapsulated to the amount of shell material. Thus, if a thicker shell layer is desired, more shell material should be used since the ratio of shell to core material generally remains constant during the preparation of the encapsulated toner particles of this invention. In addition, the size of the encapsulated particle also generally affects the shell thickness since the smaller the particle, the smaller or thinner the shell thickness will be for a constant core to shell weight ratio.

To quantitatively evaluate the non-isotropic cohesion effects due to electric-field induced polarization, the electrostatic force on each charged particle is computed by a mathematical solution of M. H. Davis (Rand Corp., 1964, RM-3860-PR) for two charged conductive spheres in an arbitrarily orientated electric field. The toner particles are assumed to be spherical with radius of 1 micrometer in a carrier liquid of dielectric constant equal to about 3. For the head-to-tail configuration, with two uncharged particles of 1 micrometer radius and separated along the field direction by 3 micrometers, an applied electric field of 10 Volts/micrometer will induce an attractive force of $1.10\times10^{-9}$ N, whereas the repulsive force due to Coulomb interaction due to a charge of $1.5\times10^{15}$ Coulomb on each particle is $6.37\times10^{-10}$ N. Thus, the particles with conductive cores will attract each other in the direction of the applied electric field, as is desirable for multilayer transfer in color printing, clean background development, and for stiffening the developed image.

For the side-by-side particle configuration, to simulate the situation of splitting oppositely charged toners at the boundary between image and background at the exit of development nip, the net force due to polarization by a 10 V per micrometer electric field and the Coulombic attraction for two oppositely charged conductive particles of 1 micrometer radius, $1.5\times10^{-15}$ C net charge, and 3 micrometer separation is repulsive with a magnitude of $1.93\times10^{-10}$ N. As the field strength decreases, the field-induced polarization is weakened and so is the repulsive force. For example, the net force between the two oppositely charged particles may become attractive instead of repulsive if the applied field strength is reduced below about 10 V per micrometer without reducing the net charge on the particles. Nevertheless, the polarization effects with conductive particles in an applied electric field are shown to significantly reduce the undesirable cohesion or attraction between oppositely charged toner particles in the development nip. This improves the separation of the image and background regions in the development zone according to toner charge polarity.

EXAMPLE II

Preparation of Toner with Electrically Conductive Core and Electrically Insulating Shell:

A mixture of 113 grams of lauryl methacrylate, available as ROCRYL 320 from Rohm and Haas Company, 3.70 grams each of 2,2'-azobis-(2,4-dimethylvaleronitrile) and 2,2'-azobis-(isobutyronitrile), and a solution of 46.8 grams of Isonate 143 L in 20 milliliters of dichloromethane is mixed in a 2-liter Nalgene container with an IKA polytron equipped with a PT 45/M probe at 4,000 rpm for 30 seconds. Three hundred (300) grams of Bayferrox magnetite 8610 is then added, and the resulting mixture is homogenized by high sheer blending with the IKA polytron at 8,000 rpm for 3 minutes. To the mixture is then added 1 liter, 0.14 percent, of aqueous poly(vinyl alcohol) (88 percent hydrolyzed; MW, molecular weight average of 96,000) solution, and thereafter, the mixture is blended at 9,000 rpm with an IKA polytron equipped with a T45/4G probe for 2 minutes. To form the insulating shell, the resulting mixture is then transferred to a 2-liter reaction kettle, and a solution of 31.5 milliliters of 1,4-bis(3-aminopropyl)piperazine in 80 milliliters of water is added. The resulting mixture is mechanically stirred at room temperature for 15 minutes before the addition of 5.7 milliliters of 3-aminopropyltrimethoxysilane. After the addition, the mixture is further stirred for another 45 minutes to complete the interfacial polymerization reaction. Thereafter, the mixture is heated in an oil bath to initiate the core binder-forming free radical polymerization. The temperature of the mixture is gradually raised from room temperature to a final temperature of 90° C. over a period of 1 hour. Heating is continued at this temperature for an additional 5.5 hours, and thereafter the mixture is cooled to room temperature, about 25° C. The microcapsule toner product formed is then transferred to a 4-liter beaker, and washed repeatedly with water until the washing is clear, and the product is then sieved through a 180 micron sieve to remove coarse material.

EXAMPLE III

Magnetic Toner Preparation and Evaluation:

A mixture (74 weight percent of the total mixture) of a copolymer resin comprising a mixture of styrene and butadiene monomers and a polypyrrole polymer (10 weight percent of the mixture of resins) may be melt extruded with 10 weight percent of REGAL 330® carbon black and 16 weight percent of MAPICO BLACK® magnetite at 120° C., and the extrudate pulverized in a Waring blender and jetted and classified to 8 micron number average sized particles as measured by a Coulter Counter with a classifier equipped with a classifier wheel. The resulting particles are solution coated with an electrically insulating coating comprising, for example, a polymethylmethacrylate polymer. A positively charging magnetic toner is prepared by surface treating the resulting electrically insulting coated toner particles (2 grams) with 0.12 gram of a 1:1 weight ratio of AEROSIL R972® (Degussa) and TP-302 a naphthalene sulfonate and quaternary ammonium salt (Nachem/Hodogaya SI) charge control agent.

Developer compositions are prepared by admixing 3 parts by weight of the aforementioned toner composition with 97 parts by weight of a carrier comprised of a steel core with a polymer mixture thereover containing 70 percent by weight of KYNAROR, a polyvinylidene fluoride, and 30 percent by weight of polymethyl methacrylate; the coating weight being about 0.9 percent. Cascade development may be used to develop a Xerox Model D photoreceptor using a "negative" target. The light exposure may be set between 5 and 10 seconds and a negative bias used to dark transfer the positive toned images from the photoreceptor to paper.

Fusing evaluations are carried out with a Xerox Corporation 5028® soft silicone roll fuser, operated at 7.62 cm (3 inches) per second.

The actual fuser roll temperatures are determined using an Omega pyrometer and checked with wax paper indicators. The degree to which a developed toner image adhered to paper after fusing is evaluated using a Scotch® tape test. The fix level is expected to be excellent and comparable to that fix obtained with toner compositions prepared from other methods for preparing toners. Typically greater than 95 percent of the toner image remains fixed to the copy sheet after removing a tape strip as determined by a densitometer. Alternatively, the fixed level is quantitated using the known crease test, reference U.S. Pat. No. 5,312,704, the disclosure of which is incorporated by reference herein in its entirety.

Images may be developed in a xerographic imaging test fixture with a negatively charged layered imaging member comprised of a supporting substrate of aluminum, a photogenerating layer of trigonal selenium, and a charge transport layer of the aryl amine N,N'-diphenyl-N,N'bis(3-methylphenyl)1,1'-biphenyl-4,4'-diamine, 45 weight percent, dispersed in 55 weight percent of the polycarbonate MAKROLON®, reference U.S. Pat. No. 4,265,990, the disclosure of which is totally incorporated herein by reference. Other toner compositions embodying toners of the present invention having electrically conductive cores with an electrically insulating coating or encapsulating layer thereover may be readily prepared by conventional means including colored toners, single component toners, multicomponent toners, toners containing special performance additives, and the like.

In embodiments, the compositions and processes of the present invention can be selected for and employed in preparing polymeric particulate materials including, but not limited to, crystalline, semicrystalline, and amorphous polymeric particulate materials, and mixtures thereof.

Other modifications of the present invention may occur to one of ordinary skill in the art based upon a review of the present application and these modifications, including equivalents thereof, are intended to be included within the scope of the present invention.

What is claimed is:

1. A toner composition comprising electrically conductive core particles with an electrically insulating shell thereover, wherein the toner has a conductivity of from about $10^{-15}$ to about $10^{-10}$ (ohm-cm)$^{-1}$; wherein the electrically conductive core has a conductivity of from about $10^{-5}$ to about $10^{-9}$ (ohm-cm)$^{-1}$; and wherein the electrically insulating shell has a conductivity of from about $10^{-15}$ to about $10^{-18}$ (ohm-cm)$^{-1}$.

2. A toner composition in accordance with claim 1, wherein the electrically conductive core particles are selected from the group consisting of a mixture of at least one resin and conductive additives, electrically conductive polymers, and mixtures thereof.

3. A toner composition in accordance with claim 2, wherein from 2 to about 10 resins are selected.

4. A toner composition in accordance with claim 2, wherein the conductive additive particles are selected from the group consisting of graphite, conductive colorants, metal halides, ionic salts, metal particles, metal oxide particles, conductive ceramic particles, conductive ceramers, conductive fluorocarbon particles, polyanilines, polypyrroles, polythiophenes, conductive charge transfer complexes, and mixtures thereof.

5. A toner composition accordance with claim 1, wherein the electrically conductive core particles are selected from the group consisting of an oxidized organic salt, a charge transport compound, a colorant, and mixtures thereof, in an amount of from about 1 to about 65 weight percent of the toner; and a polymer resin, wherein the core particles have a volume average diameter of from about 1 to about 40 microns, and wherein the shell has a thickness of from 0.0005 to about 5 microns.

6. A toner composition accordance with claim 5, wherein the oxidized organic salt is selected from the group consisting of oxidized arylamine salts, oxidized oligo-arylamine salts, oxidized oligo-aryldiamine salts, oxidized oligothiophene salts, oxidized oligo-aniline salts, oxidized porphyrin salts, oxidized tetrathiotetracene salts, oxidized tetraselenotetracene salts, oxidized mono and oligotetrathiafulvalene salts, oligo-tetraselenafulvalene salts, oxidized oligo-metallocene salts, and mixtures thereof.

7. A toner composition in accordance with claim 5, wherein the charge transport compound is selected from the group consisting of N,N,N-triarylamine containing compounds, carbazole compounds, oligothiophene compounds, carbon-60 fullerene compounds, and mixtures thereof.

8. A toner composition in accordance with claim 5, wherein the polymer resin is selected from the group consisting of inert polymers, charge transport polymers, and mixtures thereof.

9. A toner composition in accordance with claim 8, wherein the inert polymers are selected from the group consisting of vinyl polymers and copolymers thereof, norbornene polymers, condensation polymers, silicone polymers, and mixtures thereof, and wherein the charge transport polymers are selected from the group consisting of arylamine containing polymers, aryldiamine containing polymers, polyvinylcarbazoles, polypolythiophenes, polysilanes, polyanilines, poly(phenylene vinylenes), polyphenylenes, poly(phenylene sulfides), polyanilines, poly(phenylene sulfide phenylenamine), copolymers thereof, and mixtures thereof, in amounts of from about 30 to about 80 weight percent of the total weight of the core.

10. A toner composition in accordance with claim 5, wherein there is selected a mixture of oxidized organic salt and charge transport compound as the conductive core in a weight percent ratio of from about 0.01:99.99 to about 99.99:0.01.

11. A toner composition in accordance with claim 1, wherein the core and shell independently comprise at least one resin with a weight average molecular weight (Mw) of from about 1,000 to about 500,000, and a number average molecular weight (Mn) of from about 1,000 to about 500,000.

12. A toner composition in accordance with claim 1, wherein the electrically insulating shell is selected from the group consisting of at least one insulating resin, and at least one insulating resin in combination with insulating metal oxide particles, and wherein the shell is present in an amount of from about 0.01 to about 30 weight percent of the toner, the core is present in an amount of from about 20 to about 98 weight percent of the toner.

13. A toner composition in accordance with claim 12, wherein from 2 to about 10 insulating resins are selected.

14. A toner composition in accordance with claim 12, wherein said insulating resins are polymers or copolymers selected from the group consisting of acrylates, styrenes, polyesters, silicone polymers, norbornene polymers, polycarbonates, and mixtures thereof.

15. A toner composition in accordance with claim 1, further comprising surface additives present in an amount of from about 0.05 to about 5 weight percent.

16. A toner in accordance with claim 1, the electrically conductive core particles comprise a mixture of magnetite and a copolymer resin, the electrically insulating shell comprises a polymethylmethacrylate polymer, and wherein the toner has a conductivity of from about $10^{-15}$ to about $10^{-10}$ (ohm-cm)$^{-1}$.

17. An imaging process comprising: developing latent images with a toner comprising electrically conductive core particles with an electrically insulating polymer shell thereover, wherein the electrically insulating shell redistributes charge on the toner particle surface and eliminates non-uniform particle surface charge effects and print defects resulting therefrom, wherein the toner has a conductivity of from about $10^{-15}$ to about $10^{-10}$ (ohm-cm)$^{-1}$; wherein the electrically conductive core has a conductivity of from about $10^{-5}$ to about $10^{-9}$ (ohm-cm)$^{-1}$; and wherein the electrically insulating shell has a conductivity of from about $10^{-15}$ to about $10^{-18}$ (ohm-cm)$^{-1}$.

18. A process in accordance with claim 17, wherein said developing is accomplished by separating toner in the image area and that in the background area according to their charge polarities with a toner comprising electrically conductive core particles wherein the electrically conductive core effectively maximizes the polarizability of the toner particles so as to reduce or eliminate lateral attraction force between toner particles of opposite charge polarities while enhancing attraction between toner particles in the field direction to improve developability and print quality.

19. A process in accordance with claim 17, further comprising transferring multilayer toner particles, wherein the electrically conductive core effectively maximizes the polarizability of the toner particles and improves transfer efficiency through enhanced electrorheological cohesion in the direction of the applied electric field.

* * * * *